US005295790A

United States Patent [19]

Bossart et al.

[11] Patent Number: 5,295,790

[45] Date of Patent: Mar. 22, 1994

[54] FLOW-CONTROLLED SAMPLING PUMP APPARATUS

[75] Inventors: Clayton J. Bossart, Monroeville; Charles H. Etheridge, Jr.; Craig D. Gestler, both of Pittsburgh, all of Pa.

[73] Assignee: Mine Safety Appliances Company, Pittsburgh, Pa.

[21] Appl. No.: 994,532

[22] Filed: Dec. 21, 1992

[51] Int. Cl.[5] ..... F04B 49/06; F04B 49/08

[52] U.S. Cl. ..... 417/43; 417/45; 417/63; 417/234; 73/861.52

[58] Field of Search ..... 417/43, 45, 63, 234; 73/861.52

[56] References Cited

U.S. PATENT DOCUMENTS

| | | | |
|---|---|---|---|
| 3,504,542 | 4/1970 | Blevins | 73/861.52 |
| 3,626,755 | 12/1971 | Rudolph | 73/861.52 |
| 4,063,824 | 12/1977 | Baker et al. | 417/43 |
| 4,389,903 | 6/1983 | Bertone et al. | 73/863.03 |
| 4,527,953 | 7/1985 | Baker | 417/63 |

OTHER PUBLICATIONS

MSA Instruction Manual for Flow-Lite TM Sampling Pumps 479876 TAL(L) Rev 5, 1987.

*Primary Examiner*—Richard A. Bertsch
*Assistant Examiner*—David W. Scheuermann
*Attorney, Agent, or Firm*—James G. Uber

[57] ABSTRACT

A portable sampling pump apparatus including a flow control mechanism having a laminar flow meter for providing a precise readout of the volumetric flow rate of the pump as well as feedback control for the pump motor. The pump apparatus includes an electric motor, a pump operably driven by the electric motor, a laminar flow element positioned in a flow path of the pump, a pressure transducer for sensing a pressure drop across the laminar flow element and for producing an electrical signal that is directly and linearly proportional to the volumetric flow rate through the pump, and a motor control circuit which uses the electrical signal to control the voltage applied to the motor and to thereby regulate the flow of the pump. This electrical signal is also used to generate a display for the user of the volumetric flow of the pump.

16 Claims, 2 Drawing Sheets

FLOW-CONTROLLED SAMPLING PUMP APPARATUS

FIELD OF THE INVENTION

The present invention relates in general to pump apparatus and, in particular, to pump apparatus adapted for use with personal or area air sampling equipment which collects airborne contaminants.

BACKGROUND OF THE INVENTION

Air sampling equipment for collecting airborne contaminants such as toxic mists, dusts, particulates, gases and vapors are known. Typically, such equipment is connected to a source of vacuum, e.g., a pump, whereby the airborne contaminants may be drawn into the equipment through the action of the pump. The pumps associated with air sampling equipment, commonly known as personal sampling pumps, are lightweight and portable such that they may conveniently be worn by an industrial hygienist or other worker who must perform activity in environments whose ambient air may be contaminated and/or hazardous.

At present, most personal sampling pumps used for this type of sampling utilize some form of electronic flow control mechanism to vary the voltage applied to the pump motor in an attempt to maintain a substantially constant flow rate. In these devices, the relationship between the flow rate and the applied voltage is an "inferential" one. In an inferential control system, the instantaneous relationship between the electrical parameters (voltage and current) of the pump motor and the flow rate due to the pneumatic load is preestablished and inflexible. This fixed relationship is then used to design a feed-forward motor voltage control circuit to provide compensation for pneumatic load changes, motor temperature changes, and the like. An example of a device using such a system is the Flow-Lite TM pump manufactured by the Mine Safety Appliances Company ("MSA") of Pittsburgh, Pa.

U.S. Pat. No. 4,063,824 discloses an air sampling pump system wherein the pressure drop across the orifice of a needle valve is converted by a pressure switch and appropriate circuitry into a signal which establishes the voltage applied to the pump motor. This indirect control system still does not directly measure and display the volumetric flow rate through the pump. An example of another type of control system is provided in U.S. Pat. No. 4,389,903. This system uses mass flow instead of volumetric flow such that the temperature change of a hot wire anemometer is converted by suitable circuitry into a voltage signal for controlling the pump motor.

While indirect and inferential control systems generally function well, they do not directly measure and display the actual volumetric flow rate through the pump. They also possess some inherent practical limitations which affect their flow control accuracy. For example, as the pump ages, such control systems cannot automatically compensate for changes in pump characteristics. To achieve the required compensation under such circumstances, one must physically reset the appropriate compensation controls of the pump. In addition to flow changes induced by normal aging and wear of the pump components, more severe changes due to dirt in bearings or pump valves, misaligned crank arms resulting from mechanical shock, etc., may occur. The inferential and indirect control techniques described above are incapable of differentiating these flow changes from a change in load demand. As a consequence, the voltage applied to the pump motor may differ significantly from the desired voltage, thereby resulting in a flow rate distorted by influences unrelated to fluctuations in the flow rate caused by the load.

An advantage exists, therefore, for a personal sampling pump apparatus including an electronic flow control mechanism having a flow sensor for directly measuring and displaying the volumetric flow of the pump. This signal is then used to control the pump motor such that the mechanism operates unencumbered by variations in operational characteristics of the pump.

SUMMARY OF THE INVENTION

Generally, the present invention relates to a portable pump apparatus adapted for use with air sampling equipment for collecting airborne contaminants. The pump apparatus includes a flow control mechanism having a flow sensor that generates an electrical signal proportional to the volumetric flow rate through the pump and a control circuit which provides feedback to the pump such that the flow control mechanism functions with accuracy regardless of variations in pump characteristics. Preferably the electrical signal generated by the flow sensor is directly and linearly proportional to the volumetric flow rate through the pump. This signal is used by a motor control circuit to control the motor voltage of the pump and is also displayed to the user.

The flow sensor of the present invention, which is also called a laminar flow meter, comprises a laminar flow element operating in conjunction with an electronic differential pressure transducer which measures the pressure drop across the laminar flow element. Advantages of such an arrangement in relation to presently available flow meter devices such as hot wire anemometers, differential thermal sensors, orifice meters, and the like, include high precision, fast response, low pressure drop, excellent linearity, relatively low temperature bias (typically less than 0.15% per degree F.), virtually no absolute pressure sensitivity, simplicity of design (no moving parts), wide flow range (limited only by accuracy of differential pressure measurement at low pressures) and ease of use.

Other details, objects and advantages of the present invention will become apparent as the following description of the presently preferred embodiments and presently preferred methods of practicing the invention proceeds.

BRIEF DESCRIPTION OF THE DRAWINGS

The present invention will become more readily apparent from the following description of preferred embodiments thereof shown, by way of example only, in the accompanying drawings, wherein.

DETAILED DESCRIPTION OF THE INVENTION

Figure 1:
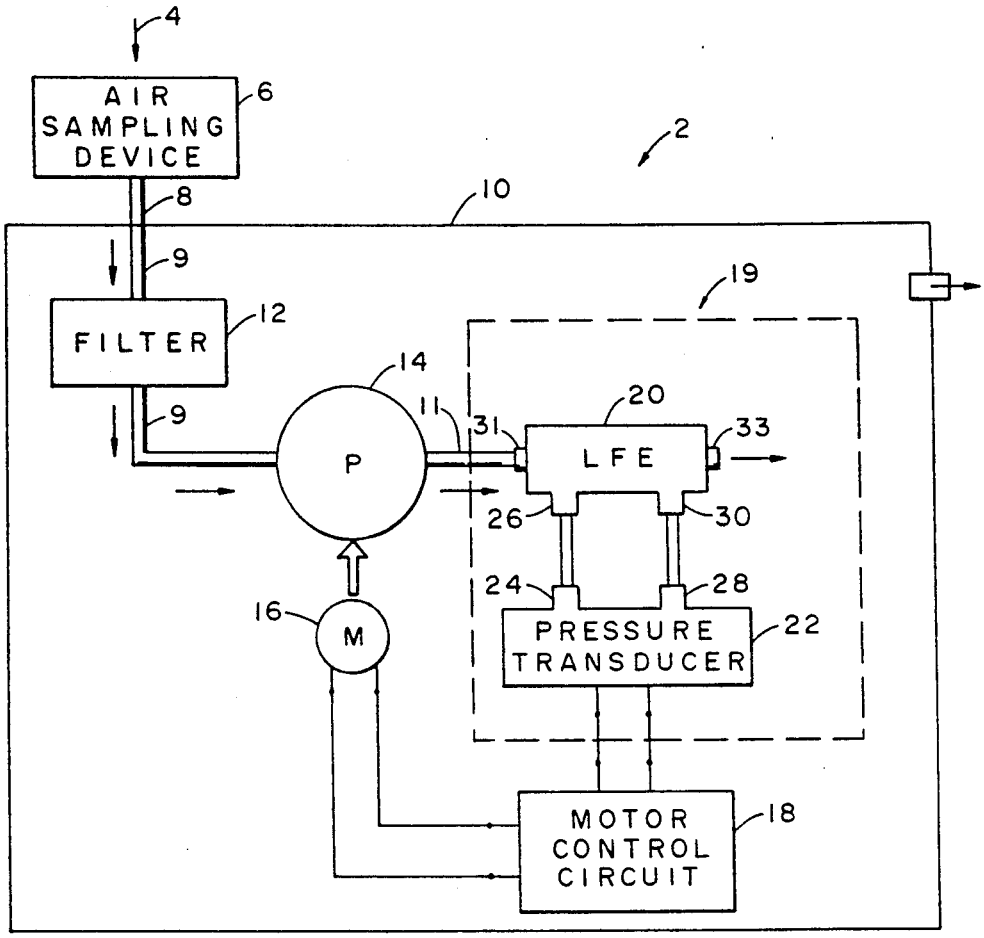
FIG. 1 is a schematic representation of a preferred embodiment of a personal sampling pump apparatus constructed according to the present invention.

With reference to FIG. 1, during normal operation, the sampling pump apparatus 2 of the present invention draws a stream of air, herein designated by arrow 4, into an air sampling device 6. Air sampling device 6 may be an impinger, a charcoal sampling tube, a dust collection filter or any of a wide variety of devices used by industrial hygienists or related personnel depending upon the particular air sampling requirements. After passing through the air sampling device 6, the air stream is delivered by interconnecting tubing 8 into a housing 10 of the portable personal sampling pump apparatus 2. Inside housing 10, the air stream (minus the airborne contaminants collected by the sampling device 6) may pass an optional filter 12 provided in the intake path 9 of a variable displacement pump 14. Pump 14 may assume any suitable form such as, for example, a piston pump or a diaphragm pump, although a dual head diaphragm pump design is preferred for the advantages it offers in terms of enhanced efficiency, capacity and smooth flow characteristics. Pump 14 is driven by an electric motor 16 whose input voltage is regulated by a flow control mechanism comprising a motor control circuit 18 and a laminar flow meter 19 to be described in greater detail hereinafter.

More particularly, the laminar flow meter 19 comprises a laminar flow element 20 operating in conjunction with an electronic differential pressure transducer 22, which measures the pressure drop across the laminar flow element 20.

The linearity of the laminar flow meter 19 of the present invention requires that the Reynolds number generated by the laminar flow element 20 be kept below 1600 and, preferably, below 500. One type of laminar flow meter is a bundle of capillary tubes. As a general rule, the capillary flow path length should be at least 100 times the flow path diameter. To achieve both of these criteria for the normal flow range of portable personal sampling pumps (up to 5000 ml/min.), a large bundle of tubes would normally be required. This would unduly increase the size of the pump apparatus.

Figure 2:
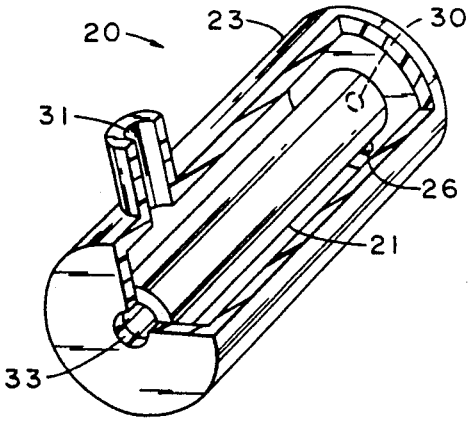
FIG. 2 is a cut-away view of one embodiment of the laminar flow element.
Figure 3:
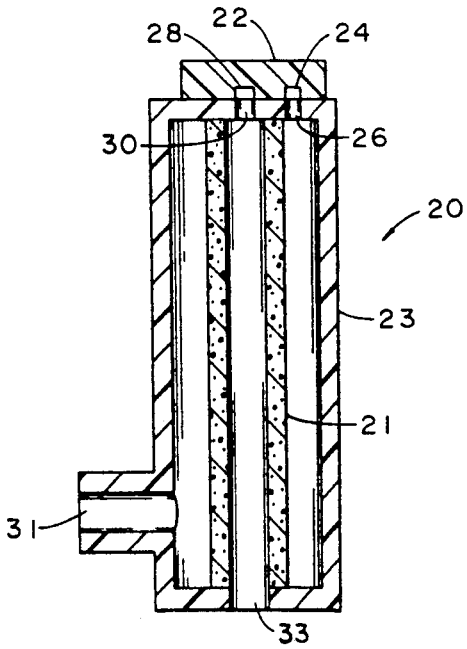
FIG. 3 is a cross-sectional view of the laminar flow-element of FIG. 2 shown connected to the pressure transducer to form the flow sensor of the present invention.

It has been discovered through the development of the present invention, however, that a porous member 21 in a suitable housing 23 will simulate this linear relationship between flow rate and pressure drop in a portable personal sampling pump. Hence, a porous member 21 in housing 23 is the preferred embodiment of the laminar flow element 20 of the present invention as shown in FIGS. 2 and 3. Preferably, housing 23 is made of a rigid material, such as plastic. Housing 23 can also have a portion thereof made of a flexible material such as rubber which will act as a pulsation dampener for any pump pulses.

Experiments with stainless steel porous members of assorted forms have shown excellent results in achieving the desired linearity with a small size. These members have included powdered metal discs from ½" to 1" in diameter with thicknesses from 1/16" to 3/16" and nominal porosities from 20% to 80% with pore sizes from 20 to 100 microns. Other forms which have been tested include porous cylinders of various dimensions, preferably, ¼" O.D.×⅛" I.D×1" long. While the flat disc and the cylinder constructions yield similar results, it has been found to be generally more mechanically expedient to use a cylinder-shaped porous member 21. Such a member is shown in FIG. 2 and preferably has a Reynolds number of about 150. The following description of the present invention is based on the cylindrical porous member 21, but the invention is not and should not be construed to be limited to any particular form of the laminar flow element 20 such as a porous plug, a bundle of capillary tubes or other suitable element.

Placement of the laminar flow element 20 in the pump flow path is also a matter of preference. For example, the laminar flow element 20 may be placed in the intake path 9 (vacuum side) of the pump 14 which then requires that both the high and low side ports of the electronic pressure transducer 22 be connected to the high and low side ports of the laminar flow element 20. In this configuration, the actual vacuum load should be measured relative to ambient pressure with a second pressure transducer in order to provide the appropriate compensation signal. With this arrangement, the second sensor enables the volumetric flow measured at the load condition to be converted to a measurement at ambient conditions.

A simpler approach, however, which reflects the preferred embodiment of the invention represented by FIG. 1, places the inlet port 31 of laminar flow element 20 in the outlet path 11 of the pump 14. With this arrangement, no vacuum load correction is required. The high pressure port 24 of the pressure transducer 22 must be connected together to the high pressure port 26 of the laminar flow element 20. Preferably, the low pressure ports 28 and 30 of the pressure transducer 22 and laminar flow element 20, respectively, should be (but do not have to be) connected to eliminate the effects of the internal (ambient) pressure of housing 10. The outlet port 33 of laminar flow element 20 can be vented into housing 10 as shown in FIG. 1 or outside, depending on other design considerations.

Figure 4:
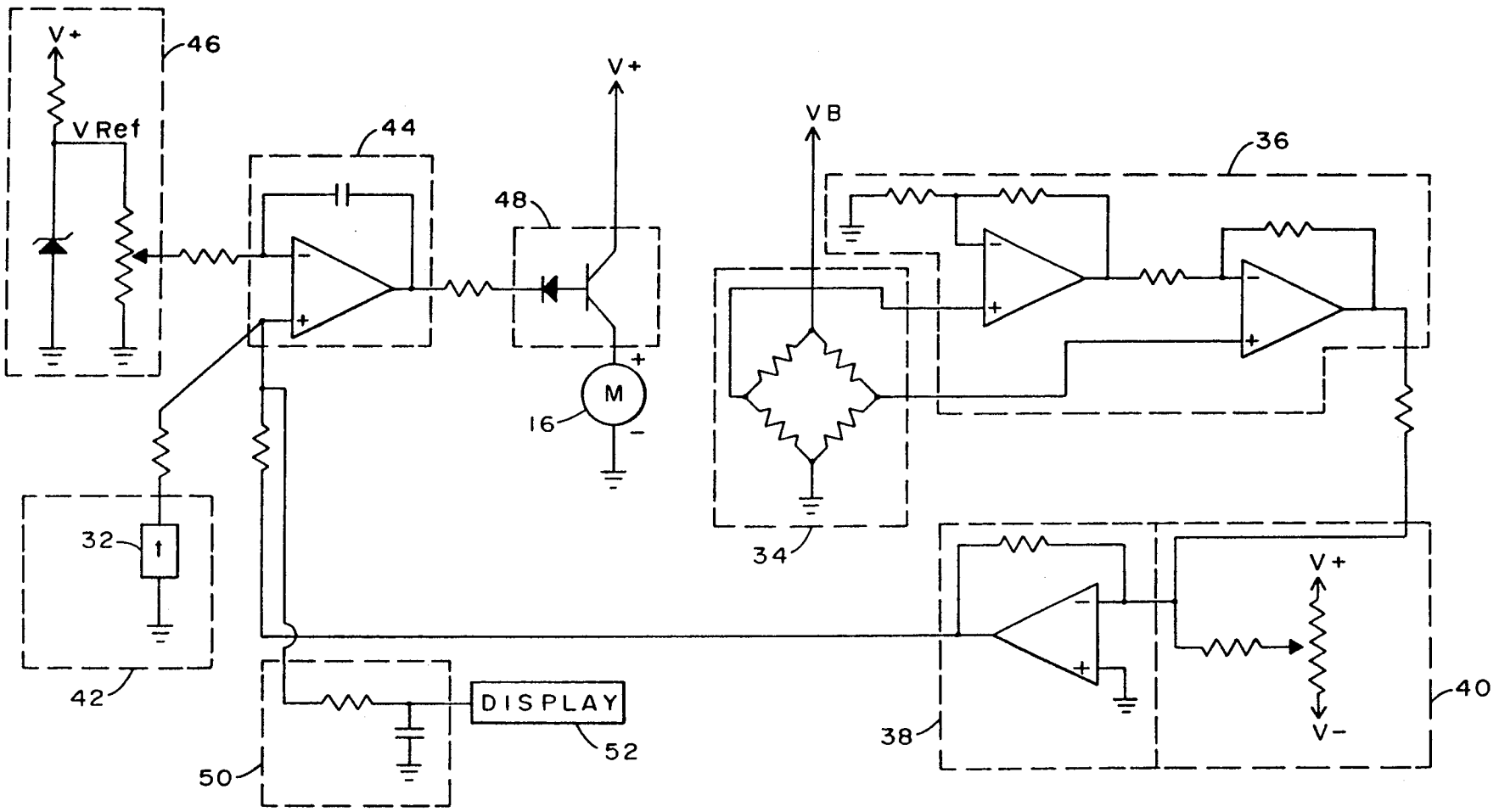
FIG. 4 is a circuit diagram of a pump motor control circuit adapted for use in the pump apparatus of the present invention.

The signal output from the pressure transducer 22 can be conditioned in the motor control circuit 18 to provide feedback to produce a variable voltage output from the circuit 18 to be applied to motor 16. A presently preferred circuit arrangement for motor control circuit 18 is shown in FIG. 4. This circuit additionally provides temperature compensation capability to correct for viscosity changes which are directly proportional to temperature over the range of interest via a temperature sensing transducer 32. Circuit 18 is battery powered and constructed of transistors, capacitors, resistors, diodes and amplifiers, the functions of which are known to those skilled in the electrical art. For purposes of simplicity, therefore, the following discussion of motor control circuit 18 will, in the main, emphasize the interrelationships of the principal sub-circuits thereof which are bounded by dashed lines in FIG. 4.

A bridge circuit 34 which is part of pressure transducer 22 produces a signal proportional to the sensed pressure drop across laminar flow element 20 and transmits the signal to a high input impedance differential amplifier circuit 36 in motor control circuit 18. From the high input impedance differential amplifier circuit 36 the amplified signal is then fed to a summing amplifier circuit 38 that removes the offsets inherent in bridge circuit 34 of the pressure transducer 22. A zero pot circuit 40 is adjusted to produce a zero voltage output from summing amplifier circuit 38 when there is no flow, i.e., zero pressure differential across the pressure transducer 22.

The signal from the summing amplifier circuit 38 is then combined with the signal from a temperature compensating circuit 42 and delivered to the positive input of the amplifier of the driver amplifier circuit 44. Concurrently, an adjustable setpoint signal generated by the voltage divider of reference circuit 46 is sent to the negative input of the amplifier of the driver amplifier circuit 44. By adjusting the setpoint signal, the flow-rate of the pump can be varied. The setpoint signal is compared at the driver amplifier circuit 44 to the temperature compensated pressure signal from the summing amplifier circuit 38 and temperature compensating circuit 42. The driver amplifier circuit 44 produces a signal based on this comparison that drives a transistor circuit 48. The transistor circuit 48 regulates the input voltage to motor 16 to control the speed thereof and, thus, the output from pump 14.

Additionally, the temperature compensated pressure signal at the positive input of the driver amplifier circuit 44 is fed to a signal conditioning circuit 50 and then to a digital or analog display 52 for direct flow readout in actual volumetric flow units, e.g., in ml/minute.

Tests performed using the above-described electronic flow control mechanism of the present invention have demonstrated that flow control to within ±0.5% of the setpoint value is possible even when the vacuum load changes by as much as 30 inches water column.

Alternatively, motor control circuit 18 could be constructed digitally using an A/D converter and a micro controller-based system to control the motor voltage through any number of known mechanisms such as pulse width modulation.

Although the present invention has been described in detail for the purpose of illustration, it is to be understood that such detail is solely for that purpose and that variations can be made therein by those skilled in the art without departing from the spirit and scope of the invention except as it may be limited by the claims.

What is claimed is:

1. A sampling pump apparatus comprising:

an electric motor;

a pump operably driven by the electric motor to produce a flow rate;

a laminar flow element positioned in a flow path of the pump to provide a pressure drop across itself that is directly proportional to the flow rate of the pump;

a pressure transducer for sensing the pressure drop across the laminar flow element and producing a first signal representative of the flow rate of the pump; and a motor control circuit for receiving the first signal and for transmitting to the motor a second signal responsive to the first signal to control the motor and thereby regulate the flow rate of the pump.

2. The sampling pump apparatus of claim 1 further comprising:

a readout circuit for processing the first signal and displaying the flow rate of the pump.

3. The apparatus of claim 1 wherein the laminar flow element has a Reynolds number less than about 1600.

4. The apparatus of claim 1 wherein the sampling pump is portable.

5. The apparatus of claim 1 wherein the flow path is an outlet path of the pump.

6. The apparatus of claim 5 further comprising a pulsation dampener in the outlet path of the pump.

7. The apparatus of claim 1 wherein the laminar flow element is a porous member.

8. The apparatus of claim 7 wherein the porous member is cylindrical in shape.

9. A sampling pump apparatus comprising:

an electric motor;

a pump operably driven by the electric motor to produce a flow rate;

a laminar flow meter positioned in a flow path of the pump to provide a flow signal linearly related to the flow rate of the pump;

a control circuit for receiving the signal from the laminar flow meter and for generating a control signal responsive to the flow signal to control the motor and thereby regulate the flow rate of the pump.

10. The apparatus of claim 9 wherein the laminar flow element has a Reynolds number less than about 1600.

11. The apparatus of claim 9 further comprising a readout circuit for processing the flow signal from the laminar flow meter and displaying the flow rate of the pump.

12. The apparatus of claim 9 wherein the sampling pump is portable.

13. The apparatus of claim 9 wherein the flow path is an outlet path of the pump.

14. The apparatus of claim 13 further comprising a pulsation dampener in the outlet path of the pump.

15. The apparatus of claim 9 wherein the laminar flow element is a porous member.

16. The apparatus of claim 15 wherein the porous member is cylindrical in shape.

* * * * *

US005295790C1

(12) EX PARTE REEXAMINATION CERTIFICATE (5975th)

United States Patent
Bossart et al.

(10) Number: US 5,295,790 C1
(45) Certificate Issued: Oct. 30, 2007

(54) LOW-CONTROLLED SAMPLING PUMP APPARATUS

(75) Inventors: Clayton J. Bossart, Monroeville, PA (US); Charles H. Etheridge, Jr., Pittsburgh, PA (US); Craig D. Gestler, Pittsburgh, PA (US)

(73) Assignee: Mine Safety Appliances Co., Pittsburgh, PA (US)

Reexamination Request:
No. 90/006,507, Jan. 2, 2003

Reexamination Certificate for:

| | |
|---|---|
| Patent No.: | **5,295,790** |
| Issued: | **Mar. 22, 1994** |
| Appl. No.: | **07/994,532** |
| Filed: | **Dec. 21, 1992** |

(51) Int. Cl.
*F04B 49/06* (2006.01)
*F04B 49/08* (2006.01)

(52) U.S. Cl. ..... 417/43; 417/45; 417/63; 417/234; 73/861.52

(58) Field of Classification Search ..... 417/43, 417/45, 63, 234; 73/861.52
See application file for complete search history.

(56) References Cited

U.S. PATENT DOCUMENTS

| | | | | |
|---|---|---|---|---|
| 2,494,673 | A | | 1/1950 | Smith |
| 3,626,755 | A | | 12/1971 | Rudolph |
| 3,792,609 | A | | 2/1974 | Blair et al. |
| 4,063,824 | A | | 12/1977 | Baker |
| 4,246,788 | A | | 1/1981 | Olin |
| 4,257,746 | A | | 3/1981 | Wells |
| 4,527,953 | A | | 7/1985 | Baker |
| 4,569,235 | A | | 2/1986 | Conkle |
| 5,000,052 | A | | 3/1991 | Sipin |
| 5,269,659 | A | * | 12/1993 | Hampton et al. ..... 417/12 |

OTHER PUBLICATIONS

Holman, "Experimental Methods for Engineers", McGraw–Hill, Inc., Second Edition, pp. 188–192, 1971.*
Beckwith et al, "Mechanical Measurements", Addison–Wesley Publishing Company, third edition, pp. 484–488, Nov. 1982.*

* cited by examiner

*Primary Examiner*—Charles G. Freay

(57) ABSTRACT

A portable sampling pump apparatus including a flow control mechanism having a laminar flow meter for providing a precise readout of the volumetric flow rate of the pump as well as feedback control for the pump motor. The pump apparatus includes an electric motor, a pump operably driven by the electric motor, a laminar flow element positioned in a flow path of the pump, a pressure transducer for sensing a pressure drop across the laminar flow element and for producing an electrical signal that is directly and linearly proportional to the volumetric flow rate through the pump, and a motor control circuit which uses the electrical signal to control the voltage applied to the motor and to thereby regulate the flow of the pump. This electrical signal is also used to generate a display for the user of the volumetric flow of the pump.

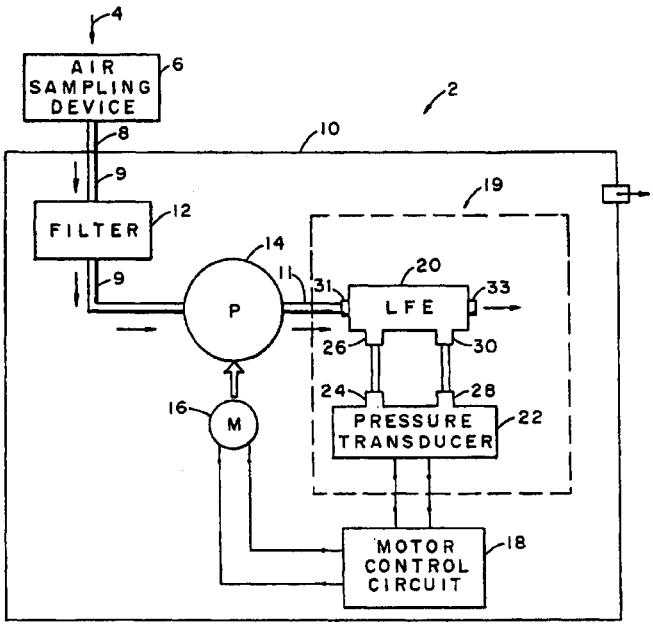

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 5, 7 and 13 are cancelled.

Claims 1, 6, 8, 9, 11 and 14–16 are determined to be patentable as amended.

Claims 2–4, 10 and 12, dependent on an amended claim, are determined to be patentable.

New claims 17–22 are added and determined to be patentable.

1. A sampling pump apparatus comprising:

an electric motor;

a pump operably driven by the electric motor to produce a flow rate;

a laminar flow element positioned in [a] *an outlet* flow path of the pump to provide a pressure drop across itself that is directly proportional to the flow rate of the pump *and wherein the laminar flow element is a porous member having a nominal porosity from 20% to 80%*;

a pressure transducer for sensing the pressure drop across the laminar flow element and producing a first signal representative of the flow rate of the pump; and a motor control circuit for receiving the first signal and for transmitting to the motor a second signal responsive to the first signal to control the motor and thereby regulate the flow rate of the pump.

6. The apparatus of claim [5] *1* further comprising a pulsation dampener [in the outlet path of the pump] *forming part of the laminar flow element*.

8. The apparatus of claim [7] *1* wherein the porous member is cylindrical in shape.

9. A sampling pump apparatus comprising:

an electric motor;

a pump operably driven by the electric motor to produce a flow rate;

a laminar flow [meter] *element* positioned in a flow path of the pump to provide a flow signal linearly related to the flow rate of the pump[;], *the laminar flow element comprising a porous member having a nominal porosity from 20% to 80% with pore sizes from 20 to 100 microns*; *and* a control circuit for receiving the signal from the laminar flow [meter] *element* and for generating a control signal responsive to the flow signal to control the motor and thereby regulate the flow rate of the pump.

11. The apparatus of claim 9 further comprising a readout circuit for processing the flow signal from the laminar flow [meter] *element* and displaying the flow rate of the pump.

14. The apparatus of claim [13] *9* further comprising a pulsation dampener in [the outlet] *a flow* path of the pump.

15. The apparatus of claim [9] *14* wherein the [laminar flow element is a porous member] *pulsation dampener forms part of the laminar flow element*.

16. The apparatus of claim [15] *9* wherein the porous member is cylindrical in shape.

*17. A sampling pump apparatus comprising:*

*an electric motor;*

*a pump operably driven by the electric motor to produce a flow rate;*

*a laminar flow element positioned in a flow path of the pump to provide a pressure drop across itself that is directly proportional to the flow rate of the pump, the laminar flow element comprising a porous member having a nominal porosity from 20% to 80% with pore sizes from 20 to 100 microns;*

*a pressure transducer for sensing the pressure drop across the laminar flow element and producing a first signal representative of the flow rate of the pump; and*

*a motor control circuit for receiving the first signal and for transmitting to the motor a second signal responsive to the first signal to control the motor and thereby regulate the flow rate of the pump.*

*18. The apparatus of claim 17 wherein the porous member is cylindrical in shape.*

*19. The apparatus of claim 17 wherein the porous member is in the shape of a disc.*

*20. The apparatus of claim 17 wherein the porous member has a Reynolds number less than about 1600.*

*21. The apparatus of claim 17 wherein the porous member comprises stainless steel.*

*22. The apparatus of claim 9 wherein the porous member comprises stainless steel.*

* * * * *